US005427574A

United States Patent [19]

Donnelly-Weide

[11] Patent Number: 5,427,574

[45] Date of Patent: Jun. 27, 1995

[54] INCLINED SLIDE STRUCTURE

[76] Inventor: Drusilla J. Donnelly-Weide, 3 S. 202 Birchwood, Warrenville, Ill. 60555

[21] Appl. No.: 217,501

[22] Filed: Mar. 24, 1994

[51] Int. Cl.[6] ..... A63G 21/02

[52] U.S. Cl. ..... 472/116; 472/117; 182/49; 104/69

[58] Field of Search ..... 472/116, 117, 136; 52/183, 184; 182/48, 49, 129; 104/69, 70; 403/220, 223, 291, 50, 51

[56] References Cited

U.S. PATENT DOCUMENTS 2,989,324 6/1961 O'Halloran ..... 403/223 X 4,730,834 3/1988 Ukai et al. ..... 403/50 X

*Primary Examiner*—Carl D. Friedman

*Assistant Examiner*—Kien Nguyen

*Attorney, Agent, or Firm*—Charles F. Meroni, Jr

[57] ABSTRACT

This invention concerns an inclined slide structure for placement onto an inclined surface or a set of stairs for amusement purposes. The inclined slide structure is comprised of a series of generally U-shaped intermediate inclined slide sections to be assembled in end-to-end relation, an uppermost U-shaped inclined slide section, a lowermost U-shaped inclined slide section, connectors for joining opposed ends of the U-shaped inclined slide sections in quick-connect and quick-disconnect end-to-end assembly together, a first U-shaped expandable connector section joining the uppermost U-shaped inclined slide section to an uppermost of the U-shaped intermediate inclined slide sections, and a second U-shaped expandable connector section joining the lowermost U-shaped inclined slide section to a lowermost of the U-shaped intermediate inclined slide sections. The first and second U-shaped expandable connector sections have expandable pleats that can be expanded and contracted longitudinally on a top portion and on a bottom portion thereof to provide an inclined and a declined section in an angled relation for attachment between the U-shaped intermediate inclined slide sections and the uppermost and lowermost U-shaped inclined slide section. The inclined slide structure also providing a water hose port to make the inclined slide structure into an inclined water slide structure. An angular turn section can also be added for inclines or stairways that have a turn mid-way down the incline.

18 Claims, 4 Drawing Sheets

INCLINED SLIDE STRUCTURE

BACKGROUND OF THE INVENTION

1. Field of the Invention

The present invention relates generally to an inclined slide structure for use on an inclined surface or a set of stairs by children for amusement purposes. More particularly, my invention can be used indoors and outdoors on inclines such as stairways and hills. My inclined slide structure is versatile and flexible to accommodate many different types of inclined surfaces. I have provided expandable or accordion connector sections to adjust my inclined slide structure to different angles and lengths according to the type and length of inclined surface used. My inclined slide structure is also made of molded plastic sections that can be quickly and easily connected and disconnected. The expandable or accordion connector sections are expandable and contractible longitudinally for adjusting the length and angle of the inclined slide structure. The inclined slide structure also provides a water hose port to make the inclined slide structure into an inclined water slide structure. The connection between my sections provides a tight fit to prevent water from leaking between the sections. Another unique feature of my inclined slide structure also includes an angular turn for inclined surfaces or stairways that have corners or angular turns mid-way through the incline.

2. Description of the Prior Art

Stair slides have been known in the art for some time, as can be seen in U.S. Pat. No. 2,270,909 dating back to 1938.

Various methods have been suggested in mounting the stair slide to a set of stairs. For example, Spizer in U.S. Pat. No. 2,270,909 suggests clamping the one piece stair slide to the stairs using clamping screws and brackets. Gimbel in U.S. Pat. No. 3,743,281 provides a stair slide structure for placement onto a set of stairs requiring each step of the stairs to have a specific height and length to conform to a specifically sized stairway. Also, Johnston in U.S. Pat. No. 3,796,429 provides stair slide using detachable section channels with telescoping legs for adjusting the incline of the stairway.

These and other types of stair slides disclosed in the prior art do not offer the flexibility and inventive features of my inclined slide structure. As will be described in greater detail hereinafter, the inclined slide structure of the present invention differs from those previously proposed.

SUMMARY OF THE INVENTION

According to my present invention I have provided an inclined slide structure for placement onto an inclined surface or a set of stairs for amusement purposes, the inclined slide structure comprising a series of generally U-shaped intermediate inclined slide sections to be assembled in end-to-end relation, an uppermost U-shaped inclined slide section, a lowermost U-shaped inclined slide section, connectors for joining opposed ends of the U-shaped inclined slide sections in quick-connect and quick-disconnect end-to-end assembly together, a first U-shaped expandable connector section joining the uppermost U-shaped inclined slide section to an uppermost section of the U-shaped intermediate inclined slide sections, and a second U-shaped expandable connector section joining the lowermost U-shaped inclined slide section to a lowermost section of the U-shaped intermediate inclined slide sections.

Another feature of my invention relates to the U-shaped expandable connector sections wherein the first and second U-shaped expandable connector sections have expandable pleats that can be expanded and contracted longitudinally on a top portion and on a bottom portion thereof to provide an inclined and a declined section in an angled relation for attachment between the U-shaped intermediate inclined slide sections and the uppermost and lowermost U-shaped inclined slide sections, whereby a downwardly angled expandable section is created when the top portion of the first U-shaped expandable connector section is expanded while the bottom portion of the first U-shaped expandable connector section is contracted, and an upwardly angled expandable section is created when the bottom portion of the second U-shaped expandable connector section is expanded while the top portion of the second U-shaped expandable connector section is contracted.

Still another feature of my invention concerns the inclined slide structure explained above wherein each of the U-shaped intermediate inclined slide sections, the uppermost and lowermost U-shaped inclined slide sections, and the first and second U-shaped expandable connector sections has a gripping rubberized coating on a bottom surface thereof so that the inclined slide structure grips onto the inclined surface and prevents the inclined slide structure from slipping down the inclined surface.

According to important features of my invention I have also provided an angular U-shaped inclined slide section having a 90 degree turn and connectors for joining ends of the angular U-shaped inclined :slide section can be connected and placed between two U-shaped intermediate inclined slide sections whereby the inclined slide structure can extend down inclines that have corners mid-way through the incline.

Yet another feature of my invention I have provided U-shaped intermediate inclined sections having different lengths so that the length of the inclined slide structure can be customized to accommodate a specific inclined length.

According to still further features of my invention I have also provided a water hose port that is placed on the inclined slide structure into an outer side of the uppermost U-shaped inclined slide section and water holes are positioned in the uppermost U-shaped inclined section slide so that water can exit the water holes and flow down the inclined slide.

Other objects, features and advantages of my invention will become more readily apparent upon reference to the following description when taken in conjunction with the accompanying drawings, which drawings illustrate several embodiments of my invention.

DETAILED DESCRIPTION OF THE PREFERRED EMBODIMENT

Figure 1:
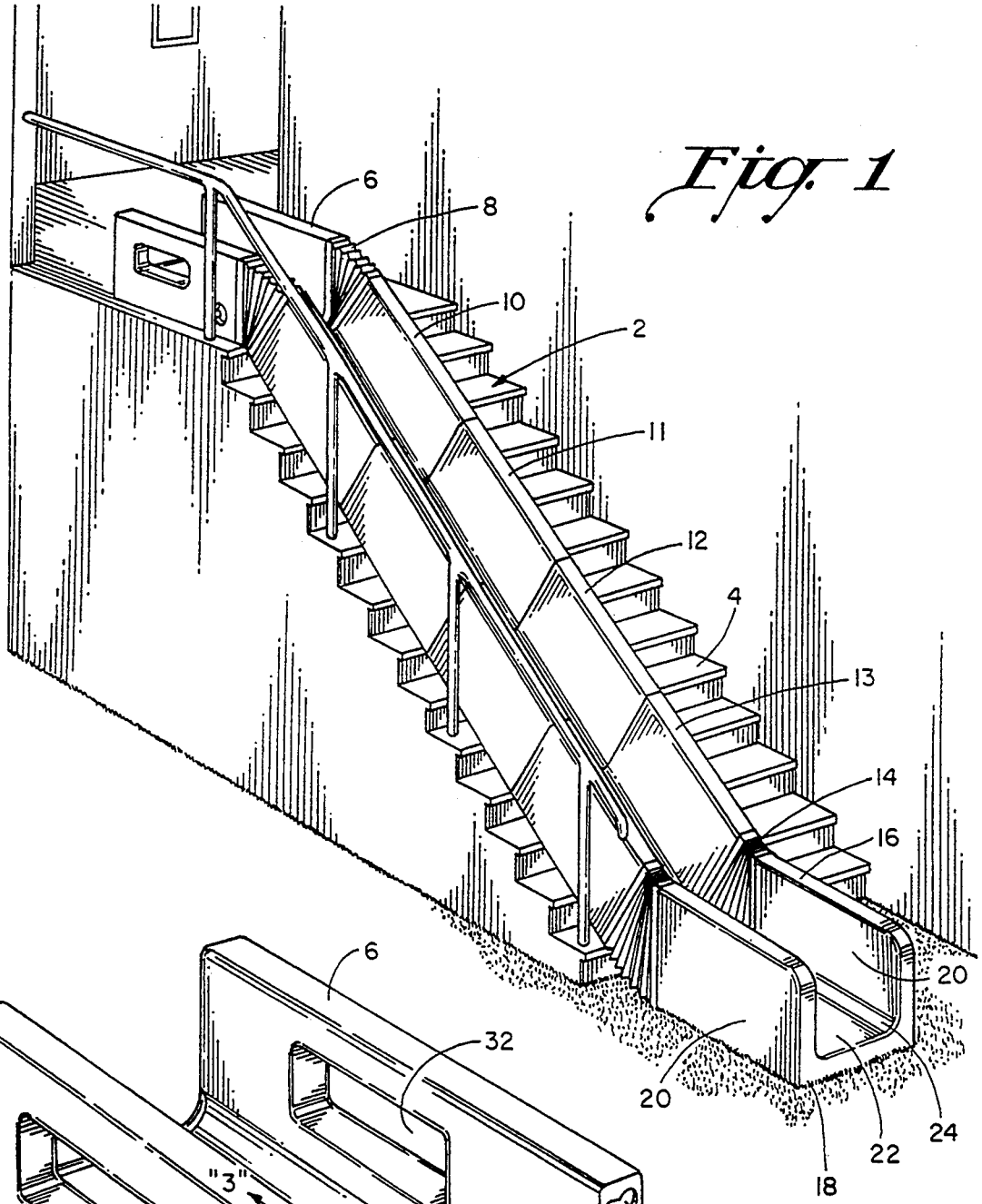
FIG. 1 is a perspective view showing my inclined slide structure mounted on a set of stairs embodying important features of my invention.

Referring now to the drawings, FIG. 1 shows my new and improved inclined slide structure 2 for placement onto an inclined surface or a set of stairs 4 for amusement purposes or onto a hill in an outdoor setting, as desired. My inclined slide structure 2 is made up of a series of generally U-shaped quick-connect water tight sections in positioned end-to-end relation. More particularly, my inclined slide structure 2 comprises an uppermost U-shaped inclined slide section 6, a first U-shaped accordion or expandable connector section 8, a series of U-shaped intermediate inclined slide sections 10–13, a second U-shaped accordion or expandable connector section 14, and a lowermost U-shaped inclined slide section 16.

The first U-shaped accordion or expandable connector section 8 connects the uppermost U-shaped inclined slide section 6 to an uppermost section 10 of the series of U-shaped intermediate inclined slide sections, and the second U-shaped accordion or expandable connector section 14 connects the lowermost U-shaped inclined slide section 14 to a lowermost section 13 of the series of U-shaped intermediate inclined slide sections. Each of the U-shaped slide sections, including the uppermost section 6, accordion sections 8, 14, intermediate sections 10–13 and lowermost section 16, has a gripping surface 18 attached to the bottom surface thereof.

Excellent results can be obtained by using a rubber coating on the bottom surface of each of these sections. This rubber coating provides resistance to prevent the inclined slide structure 2 from slipping down the inclined surface 4 thereby holding the inclined slide structure 2 in place. Added bracing and anchors may be required depending on the overall length and weight of the inclined slide structure 2. Each of the U-shaped inclined slide sections has two opposing side walls 20 and a sliding surface 22. Inside corners 24 between the sliding surface and the side walls are rounded providing a smooth surface and more comfort for sliders while sliding down the inclined slide structure 2.

Figure 2:
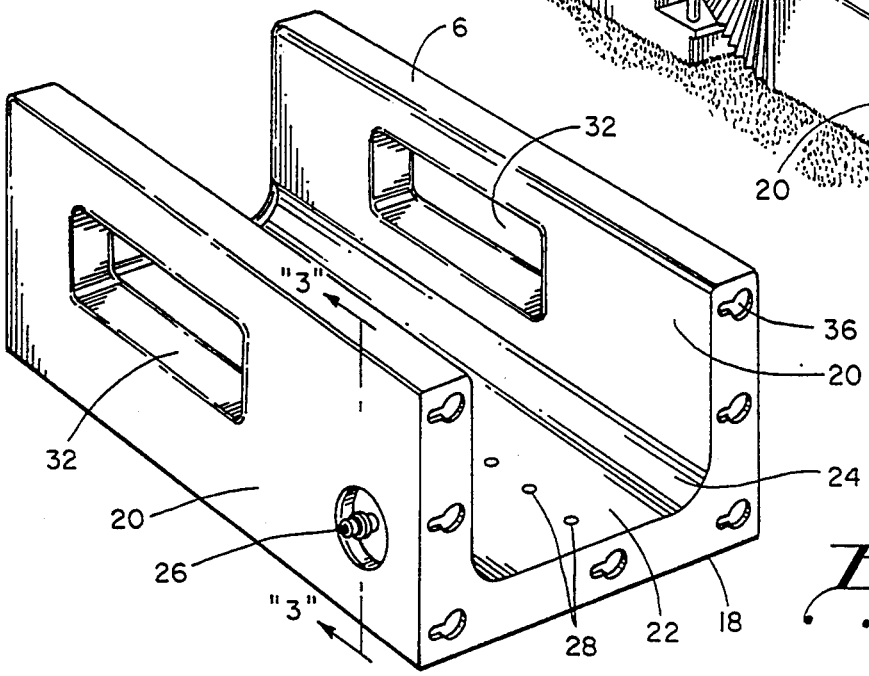
FIG. 2 is a perspective view of my uppermost U-shaped inclined slide section having a water hose port and water holes.

If desired, my inclined slide structure 2 can also be used as a water slide structure as will now be explained. In FIG. 2, the uppermost U-shaped inclined slide section 6 has a water hose port connection 26 and water holes 28 for receipt and discharge of water down the inclined slide structure 2. The inclined slide structure 2 can be comprised of a hollow, blow-molded plastic material. This type of plastic material and blow molding process makes it easy to manufacture the inclined slide structure while keeping it lightweight.

Figure 3:
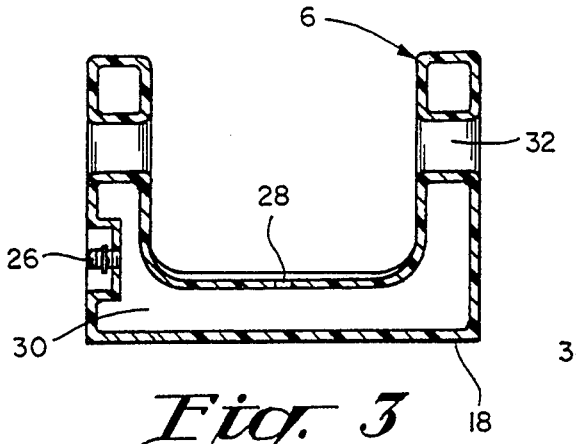
FIG. 3 is a cross-sectional view through the uppermost U-shaped inclined slide section at the water hose port and is taken along line 3—3 looking in the direction indicated by the arrows as seen in FIG. 2.

FIG. 3 illustrates a cross-sectional view of the uppermost U-shaped inclined slide section 6 having a water hose port connection 26 for receipt of water, a hollow section 30, water holes 28 for discharging the water, and a gripping surface 18. My inclined slide structure also provides hand ports 32 extending through the side walls of the uppermost U-shaped inclined slide section 6.

Figure 4:
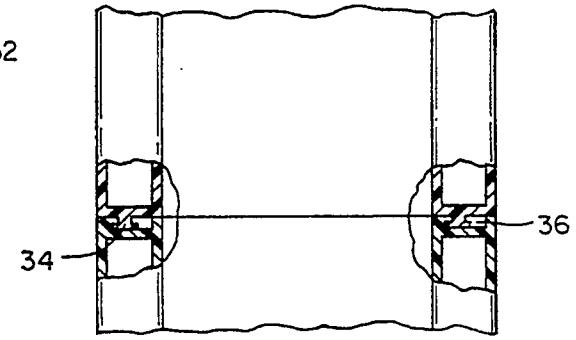
FIG. 4 is a fragmentary cross-sectional view showing two of my inclined U-shaped slide structure sections connected together.
Figure 6:
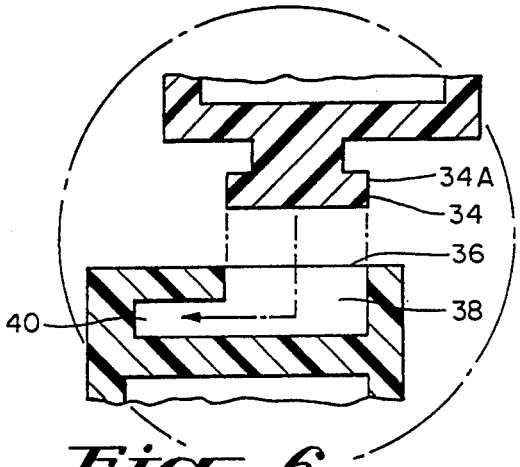
FIG. 6 is an enlarged cross-sectional view taken from circle 6 of FIG. 5 further illustrating by the direction of the arrow how my separated U-shaped inclined slide structure sections are connected together.
Figure 5:
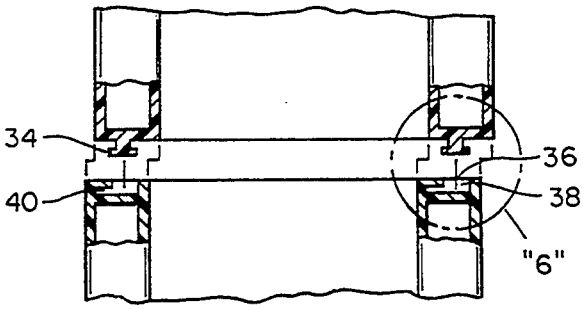
FIG. 5 is an exploded fragmentary cross sectional view showing how my inclined U-shaped slide structure sections are connected together according to features of my invention.
Figure 7:
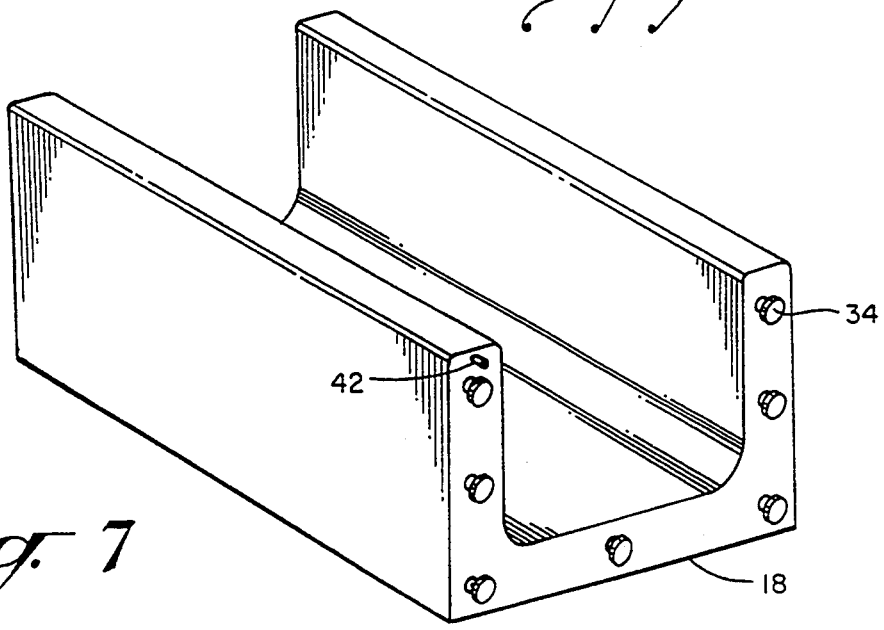
FIG. 7 is a perspective view of my U-shaped intermediate inclined slide section.
Figure 8:
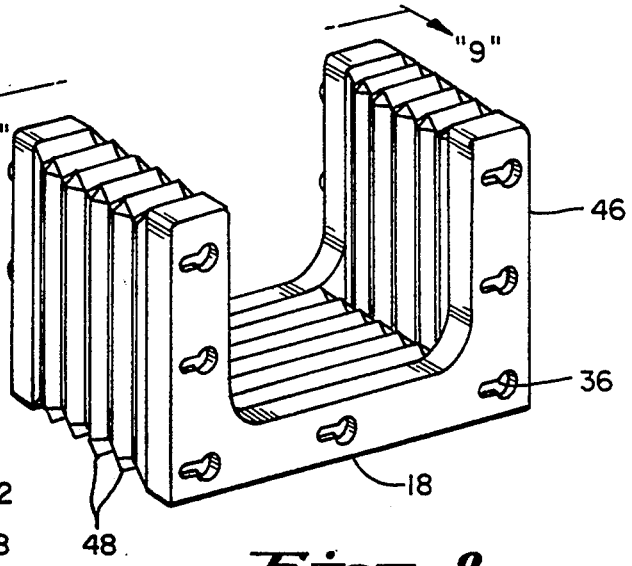
FIG. 8 is a perspective view of one side of my U-shaped expandable connector section embodying important features of my invention.
Figure 11:
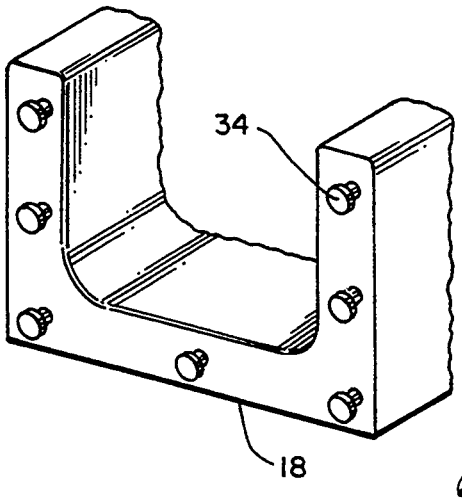
FIG. 11 is a fragmentary perspective view of the other side of my lowermost U-shaped inclined slide section as viewed from lines 11—11 looking in the direction illustrated by the arrows as seen in FIG. 10.

FIGS. 4–6 illustrate how the connecting means are used to join the U-shaped inclined slide sections together. The U-shaped intermediate inclined slide sections and the U-shaped accordion or expandable connector sections each have a set of plastic or metallic connecting pins 34 having heads 34A on one end and receptacles 36 for receipt of the connecting pins 34 on the other end (FIGS. 7 and 8). The uppermost U-shaped inclined slide section 6 only has receptacles 36 (FIG. 2) for receipt of connecting pins 34 from the first U-shaped accordion or expandable connector section 8, and the lowermost U-shaped inclined slide section 16 has connecting pins 34 (FIG. 11 ) for engagement with receptacles 36 on the second U-shaped accordion or expandable connector section 14. FIG. 4 shows a cross-sectional view of how the connecting pins 34 lie within the receptacles 36 when two U-shaped sections are completely connected. FIGS. 5 and 6 further illustrate how the connecting pins 34 are first fitted into the main hole 38 (refer also to FIG. 2) of the receptacle 36 and is then moved over through the slot 40 (refer also to FIG. 2) of the receptacle 36 in sliding engagement together.

Figure 12:
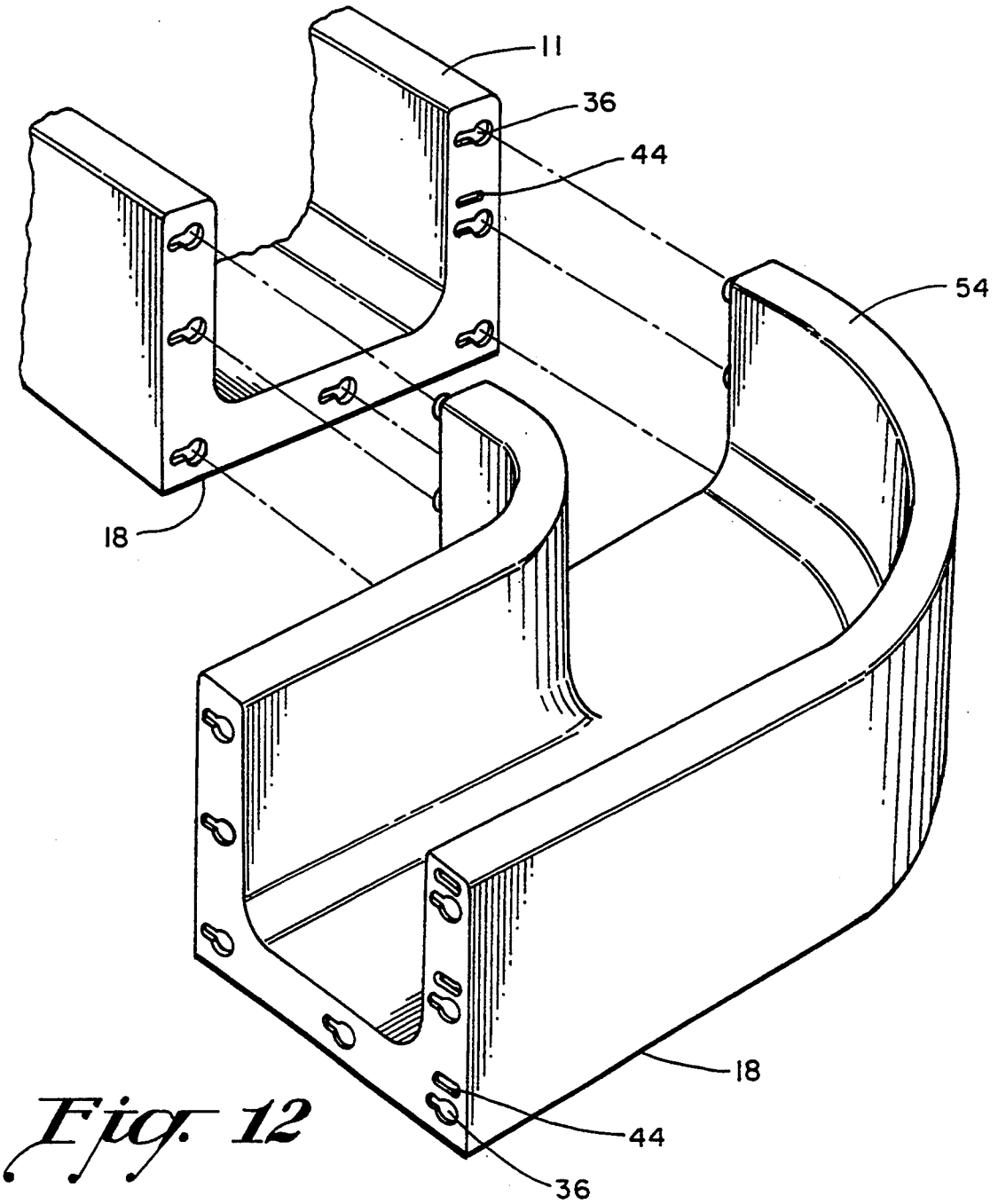
FIG. 12 is an enlarged fragmentary perspective view of my angular U-shaped inclined slide sections shown in separated relation preparatory to being connected together.

Section locating pins 42 (FIG. 7) and section locating slots 44 (FIG. 12) are provided to enable the sections to be assembled in a predetermined manner relative to one another according to still other features of my invention. This feature, if used, permits the sections to be assembled in a predetermined prescribed order to eliminate and prevent the sections from being assembled in an interchangeable manner. Using the section locating pins 42, the sections can be numbered A, B, C, etc. and assembled in an alphabetical order to aid the person to more quickly assemble the inclined slide sections together. FIG. 7 illustrates a section locating pin 42 located above one of the connecting pins 34 on a second U-shaped intermediate inclined slide section 10. The section locating pin 42 is positioned to fit into a section locating slot on a first U-shaped intermediate inclined slide section in sliding engagement. The section locating slot on the first U-shaped intermediate inclined slide section is similar to the section locating slot 44 shown in FIG. 12 but is located just above the next higher receptacle 36. The section locating slot 44 in FIG. 12 is on the second U-shaped intermediate inclined slide section 11 and is positioned to accept a section locating pin from a third U-shaped intermediate inclined slide section 12.

The U-shaped intermediate inclined slide sections 10–13 can be of different lengths in order to accommodate a specific length of the inclined surface or a set of stairs. Prospective users of the inclined slide structure 2 could obtain slides that would fit the length of their inclined surface or stairway. Excellent results can be achieved when the U-shaped intermediate inclined slide sections are 21 inches in length. If the 21 inch sections are not sufficient to accommodate a certain inclined surface, then a 10 inch U-shaped intermediate inclined slide section could be used in combination with the 21 inch U-shaped intermediate inclined slide sections to adjust the inclined slide structure to the inclined surface.

Excellent results can also be obtained by making the U-shaped walls 20, 22 approximately 2 inches thick and making the sliding surface inside 22 of the U-shape 18 inches wide, thereby making the total width of the inclined slide structure sections from one outside wall to the other outside wall 22 inches wide. Further dimensions and measurements include making the inclined slide structure 10 inches high, therefore making the walls on the inside sliding surface 8 inches high. Lengths of the uppermost and lowermost U-shaped inclined slide sections can be approximately 16 to 18 inches long. One is not limited to using these stated dimensions as various other dimensions and measurements could also be used to construct my inclined slide structure.

Figure 9:
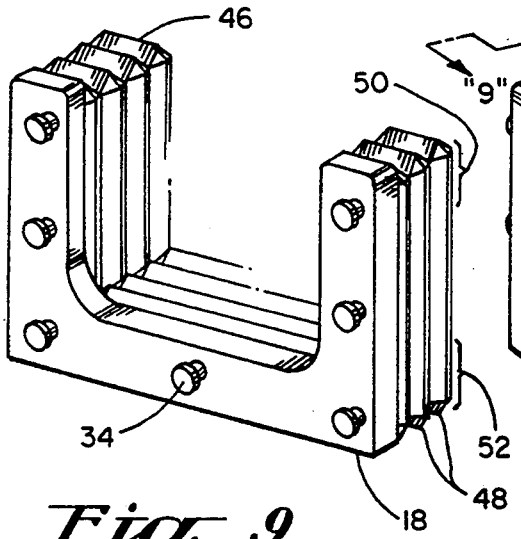
FIG. 9 is a fragmentary perspective view of the other side of my U-shaped expandable connector section as viewed from lines 9—9 looking in the direction illustrated by the arrows as seen in FIG. 8.
Figure 10:
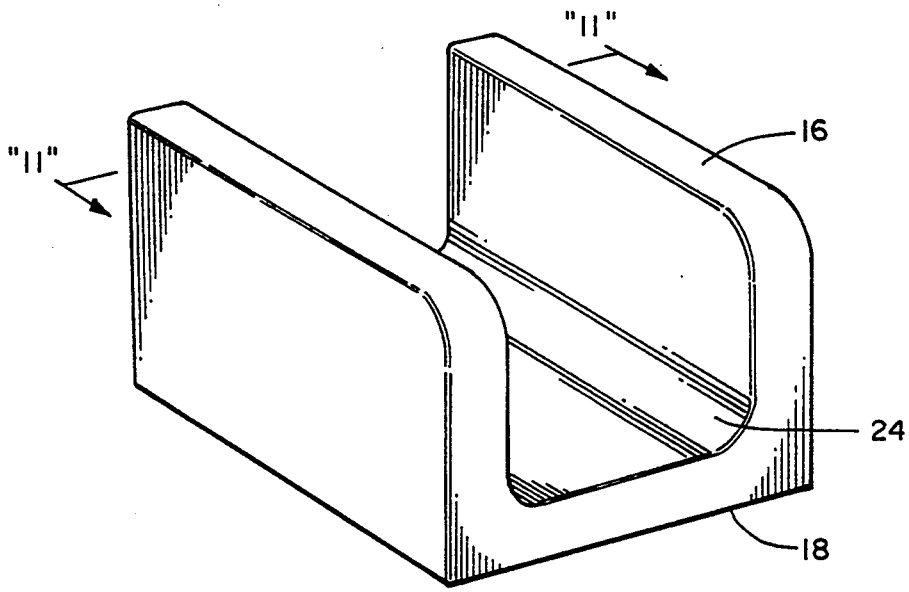
FIG. 10 is perspective view of my lowermost U-shaped inclined slide section.

The U-shaped accordion or expandable connector sections 46 (FIGS. 8 and 9) are used to join the uppermost U-shaped inclined slide section 6 (FIG. 2) and the lowermost U-shaped inclined slide section 16 (FIG. 10) to the U-shaped intermediate inclined slide sections 10–13 (FIG. 7). These accordion sections 46 have expandable pleats or folds 48 that can be expanded or contracted longitudinally thereby making the accordion or expandable sections 46 either longer or shorter. These accordion sections can also be expanded at a top portion 50 while being contracted at a bottom portion 52 or these sections can be contracted at a top portion 50 while being expanded at bottom portion 52 thereof, thereby providing an angled joint for connection between the U-shaped intermediate inclined slide sections and the uppermost and lowermost U-shaped inclined slide sections. The accordion sections 46 can also be expanded and contracted as necessary to adjust the length of the inclined slide structure 2 as is necessary to accommodate the length of the inclined surface or stairway. The U-shaped accordion or expandable sections 46 can also be made of a blow molded type plastic, however, the plastic must have some flexible properties in order to accommodate the expansion and contraction of the expandable pleats 48.

In order to accommodate inclined surfaces or stairways that have corners or angular turns mid-way through the incline, I have also provided an angular U-shaped turn section 54 (FIG. 12) for placement and connection between two U-shaped intermediate inclined slide sections. This angular U-shaped turn section 54 makes the inclined slide structure 2 more versatile for it could be used on a variety of inclined surfaces and stairways, including stairways having a turn half way down the stairway.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. An inclined slide structure comprised of a series of generally U-shaped intermediate inclined slide sections to be assembled in end-to-end relation, an uppermost U-shaped inclined slide section, a lowermost U-shaped inclined slide section, means for joining opposed ends of the U-shaped inclined slide sections in quick-connect and quick-disconnect end-to-end assembly together, a first U-shaped expandable connector section joining the uppermost U-shaped inclined slide section to an uppermost section of the U-shaped intermediate inclined slide sections, and a second U-shaped expandable connector section joining said lowermost U-shaped inclined slide section to a lowermost section of the U-shaped intermediate inclined slide sections.

2. The inclined slide structure of claim 1 wherein said first and second U-shaped expandable connector sections have expandable pleats that can be expanded and contracted longitudinally on a top portion and on a bottom portion thereof to provide an inclined and a declined section in an angled relation for attachment between said U-shaped intermediate inclined slide sections and the uppermost and lowermost U-shaped inclined slide sections, whereby a downwardly angled expandable section is created when the top portion of the first U-shaped expandable connector section is expanded while the bottom portion of the first U-shaped expandable connector section is contracted, and an upwardly angled expandable section is created when the bottom portion of the second U-shaped expandable connector section is expanded while the top portion of the second U-shaped expandable connector section is contracted.

3. The inclined slide structure of claim 2 wherein said first and second U-shaped expandable connector sections are made of a semi-flexible blow molded hollow plastic material.

4. The inclined slide structure of claim 2 wherein said first and second U-shaped expandable connector sections have an accordion type configuration for expansion and contraction.

5. The inclined slide structure of claim 1 wherein each of said U-shaped intermediate inclined slide sections, said uppermost and lowermost U-shaped inclined slide sections, and said first and second U-shaped expandable connector sections has a gripping means on a bottom surface thereof.

6. The inclined slide structure of claim 5 wherein said gripping means is comprised of a rubberized coating.

7. The inclined slide structure of claim 1 wherein hand ports extend through opposite sides of the uppermost U-shaped inclined slide section.

8. The inclined slide structure of claim 1 wherein an angular U-shaped inclined slide section having a 90 degree turn and means for joining ends of said angular U-shaped inclined slide section can be connected and placed between two U-shaped intermediate inclined slide sections whereby said inclined slide structure can extend down inclines that have corners mid-way through the incline.

9. The inclined slide structure of claim 1 wherein said U-shaped intermediate inclined sections have different lengths so that the length of said inclined slide structure can be customized to accommodate a specific inclined length.

10. The inclined slide structure of claim 1 wherein said U-shaped intermediate inclined slide sections have section locating pins and section locating slots located in different locations on each U-shaped intermediate inclined slide section to permit the U-shaped intermediate inclined slide sections to be assembled in a predetermined prescribed order thereby preventing the U-shaped intermediate inclined slide sections from being assembled in an interchangeable manner.

11. The inclined slide structure of claim 1 wherein a water hose port is placed into an outer side of the uppermost U-shaped inclined slide section and water holes are positioned in the uppermost U-shaped inclined section slide so that water can exit the water holes and flow down the inclined slide.

12. The inclined slide structure of claim 11 wherein said means for joining the sections provides a tight fit and coacts with said U-shaped inclined slide sections to provide a water tight seal when the U-shaped inclined slide sections are connected together, said U-shaped expandable connectors also providing water tight seals.

13. An inclined water slide structure comprised of a series of generally U-shaped intermediate inclined water slide sections to be assembled in end-to-end relation, an uppermost U-shaped inclined water slide section, a lowermost U-shaped inclined water slide section, means for joining opposed ends of the U-shaped inclined water slide sections in water tight quick-connect and quick-disconnect end-to-end assembly together, a first U-shaped expandable connector section joining the uppermost U-shaped inclined water slide section to an uppermost section of the U-shaped intermediate inclined water slide sections in water tight assembly, a second U-shaped expandable connector section joining said lowermost U-shaped inclined water slide section to a lowermost section of the U-shaped intermediate inclined water slide sections in water tight assembly, and a water hose port is being positioned into the uppermost U-shaped inclined water slide section and water holes are positioned in the uppermost U-shaped inclined water slide section so that water can exit the water holes and flow clown the inclined water slide.

14. The inclined water slide structure of claim 13 herein said first and second U-shaped expandable connector sections have expandable pleats that can be expanded and contracted longitudinally on a top portion and on a bottom portion thereof to provide an inclined and a declined section in an angled relation for attachment between said U-shaped intermediate inclined slide sections and the uppermost and lowermost U-shaped inclined slide sections, whereby a downward angled expandable section is created when the top portion of the first U-shaped expandable connector section is expanded while the bottom portion of the first U-shaped expandable connector section is contracted, and an upward angled expandable section is created when the bottom portion of the second U-shaped expandable connector section is expanded while the top portion of the second U-shaped expandable connector section is contracted.

15. The inclined water slide structure of claim 14 wherein said first and second U-shaped expandable connector sections are made of a semi-flexible blow molded hollow plastic material.

16. The inclined water slide structure of claim 14 wherein said first and second U-shaped expandable connector sections have an accordion type configuration for expansion and contraction.

17. The inclined water slide structure of claim 13 wherein each of said U-shaped intermediate inclined slide sections, said uppermost and lowermost U-shaped inclined slide sections, and said first and second U-shaped expandable connector sections has a gripping means on a bottom surface thereof.

18. The inclined water slide structure of claim 13 wherein an angular U-shaped inclined slide section having a 90 degree turn and means for joining ends of said angular U-shaped inclined slide section can be connected and placed between two U-shaped intermediate inclined slide sections whereby said inclined water slide structure can extend down inclines that have corners mid-way through the incline.

* * * * *